US006585556B2

(12) United States Patent
Smirnov

(10) Patent No.: US 6,585,556 B2
(45) Date of Patent: Jul. 1, 2003

(54) TALKING TOY

(76) Inventor: Alexander V Smirnov, 6038 Tyndall Ave., Bronx, NY (US) 10471

( * ) Notice: Subject to any disclaimer, the term of this patent is extended or adjusted under 35 U.S.C. 154(b) by 0 days.

(21) Appl. No.: 09/854,215

(22) Filed: May 11, 2001

(65) Prior Publication Data

US 2001/0041496 A1 Nov. 15, 2001

Related U.S. Application Data

(60) Provisional application No. 60/204,422, filed on May 13, 2000.

(51) Int. Cl.[7] ..... A63H 30/00

(52) U.S. Cl. ..... 446/175; 446/297; 446/299; 446/397

(58) Field of Search ..... 446/175, 297, 446/298, 301, 397

(56) References Cited

U.S. PATENT DOCUMENTS 4,221,927 A * 9/1980 Dankman et al. ..... 367/198
4,451,911 A * 5/1984 Klose et al. ..... 369/30.02
4,775,352 A * 10/1988 Curran et al. ..... 352/87
4,799,171 A * 1/1989 Cummings ..... 446/175
4,840,602 A * 6/1989 Rose ..... 273/460
4,857,030 A * 8/1989 Rose ..... 340/539
4,923,428 A * 5/1990 Curran ..... 434/319
5,376,038 A 12/1994 Arad et al. ..... 446/297
5,607,336 A 3/1997 Lebensfeld ..... 446/297
5,752,880 A * 5/1998 Gabai et al. ..... 434/308
5,802,488 A * 9/1998 Edatsune ..... 704/231
6,012,961 A 1/2000 Sharpe et al. ..... 446/298
6,149,490 A * 11/2000 Hampton et al. ..... 446/298
6,193,580 B1 * 2/2001 Albert et al. ..... 446/28
6,196,893 B1 * 3/2001 Casola et al. ..... 446/297
6,273,421 B1 * 8/2001 Thalheimer et al. ..... 273/161
6,290,566 B1 * 9/2001 Gabai et al. ..... 446/175
6,309,275 B1 * 10/2001 Fong et al. ..... 446/175

* cited by examiner

*Primary Examiner*—S. Thomas Hughes
*Assistant Examiner*—Alex F. R. P. Rada, II

(57) ABSTRACT

A talking toy having audible message reproduction, a storage device for storing audible messages, at least on sensor of external activation, at least one environment sensor, an electronic clock, a message selecting device, and a storage device for storing parameters for choosing audible messages. The toy reproduces messages in response to an external activation of the sensor. An audible message is selected under the influence of parameters recorded in the storage device. These parameters characterize the personality represented by the toy. The selection of messages for reproduction depends on the type of external activation, environment conditions, such as temperature and the currant time of the day, as well as a random factor. The toy reflects the change in the mood of the character depending on the factors.

12 Claims, 8 Drawing Sheets

34

| Current time | Time interval | Current time | Time interval |
|---|---|---|---|
| 0 | 12 | 12 | 0,125 |
| 1 | 12 | 13 | 0,125 |
| 2 | 12 | 14 | 0,125 |
| 3 | 12 | 15 | 0,25 |
| 4 | 12 | 16 | 0,25 |
| 5 | 12 | 17 | 0,125 |
| 6 | 12 | 18 | 0,125 |
| 7 | 0,5 | 19 | 0,125 |
| 8 | 0,5 | 20 | 0,5 |
| 9 | 0,25 | 21 | 0,5 |
| 10 | 0,25 | 22 | 12 |
| 11 | 0,25 | 23 | 12 |

TALKING TOY

This application claims the benefit of provisional application No. 60/204,422 filed May 13, 2000.

FIELD OF THE INVENTION

This invention relates generally to talking toys and, more particularly, to toys that pronounce various phrases when the user activates the toy.

BACKGROUND OF THE INVENTION

Toys that make sounds have been known for a long time and they have always been interesting for children. Latest technological achievements have been used in the industry to enable these toys to pronounce different phrases and imitate voices of people and tales characters. The number of phrases and audible messages can be rather big.

U.S. Pat. No. 5,376,038 issued to Arad, et al, 1994 shows a talking doll that speaks when particular parts of its body are pressed. The body of the doll is a housing that comprises storage means for storing prerecorded audible speech messages, speaker means for playing these messages, and a set of switches. The switches are pressure sensitive, and certain parts of doll's body are pressed to activate switches in order to produce words and other sounds that are prerecorded in storage means. The message choice is determined by the switch the user presses. There is also a mode in which a sequence of pressing on one or on several switches causes reproduction of a sequence of corresponding messages.

The limitation of this device is that pressure on certain parts of doll's head and body always results in playback of the same messages. This feature is certainly good for educating a child. But in play the doll that gives the same verbal reaction to every touch will soon become boring.

The prior art provides several solutions to this problem. For example, the U.S. Pat. No. 5,607, 336 to Lebensfeld, et al, 1997, exposes a doll or an action figure, in which it is possible to replace toy's memory with a set of messages along with replacing doll's cloths.

So the messages played back by the toy correspond to profession represented by the cloths the doll or action figure is wearing. This solution makes playing with the talking doll more versatile and helps to enlarge child's knowledge.

This device, however, has its own limitation. Once the message memory is installed in the doll, the pressure on every of the switches every time produces the same message. Messages reproduced do not depend on surrounding conditions, or time of the day. Completely predetermined character of messages has too little in common with real life context.

There were several attempts made to overcome this limitation. U.S. Pat. No. 6,012,961 issued to Sharpe, et al, 2000, discloses an electronic toy that includes a reprogrammable data storage device. The device comprises a base unit having a movable part, an electromechanical actuator, an audio output device, a digital processing device being in electrical communication with electromechanical actuator and with audio output device, a reprogrammable data storage device for selectively storing program data and sound data and a data input port for selectively receiving program data, control data and audio data from an external data source and for routing commands from an external source to digital processing device.

This invention allows to record from an external source that can be a regular PC a toy functioning program and a set of audible messages for reproduction in toy storage device. Toy functioning is possible both, when the toy is connected to a PC and, autonomously, when a toy is controlled by the recorded program. This program and commands put in by the user determine message playback and actions of the toy. This makes it possible for the user, for example for a parent, to make playing with this toy more versatile and improve its educational and entertainment features.

However, message reproduction is also predetermined in this toy and it is not connected with environment conditions, time of the day and other factors. The lack of these features limits consumer advantages of the toy.

Thus, to create the new generation talking toys, the limitations set forth above should be overcome and a device should be created that would provide a better imitation model of people and tale characters behavior.

OBJECTS AND SUMMARY OF THE INVENTION

It is an object of the present invention to provide a talking toy that when affected by the user would reproduce prerecorded audible messages and the choice of a message would depend on permanent features of toy's character, on the type of user interaction, on surrounding temperature and other environment conditions, as well as on a random factor.

Another object of the present invention is to provide a talking toy in which the method of choosing reproduced audible messages would allow to a certain extend to imitate different people and tale characters personalities, their reaction to external influence and to environment, changes in their mood during the day.

Another object of the present invention is to provide a talking toy with a possibility to change by simple means and manipulations the set of reproduced audible messages as well as the pattern that determines the choice of an audible message for reproduction under different types of activation by the user and under different environment conditions.

The further object of the present invention is to provide a possibility to diversify by simple technical means personalities of toys belonging to the same group that will increase the consumer demand for toys.

The further object of the present invention is to provide the possibility to use same electronic blocks in toys of different types that will allow to reduce product costs in the result of unification of toys parts.

The following object of the present invention is to provide a talking toy that in switched-on mode would reproduce audible messages not only when affected by the user, but also, when the user does not interact with the toy, it will deliver messages in time intervals that change depending on current time of the day.

All these and other objects of the inventions are met in the talking toy that is described in full detail below. The operation of the device is based on the choice of prerecorded set of messages. The choice of a message is made depending on permanent features set for the given toy, on current time of the day, on environment conditions, on type of interaction with the user, and on a random factor.

DETAILED DESCRIPTION OF THE INVENTION

Figure 1:
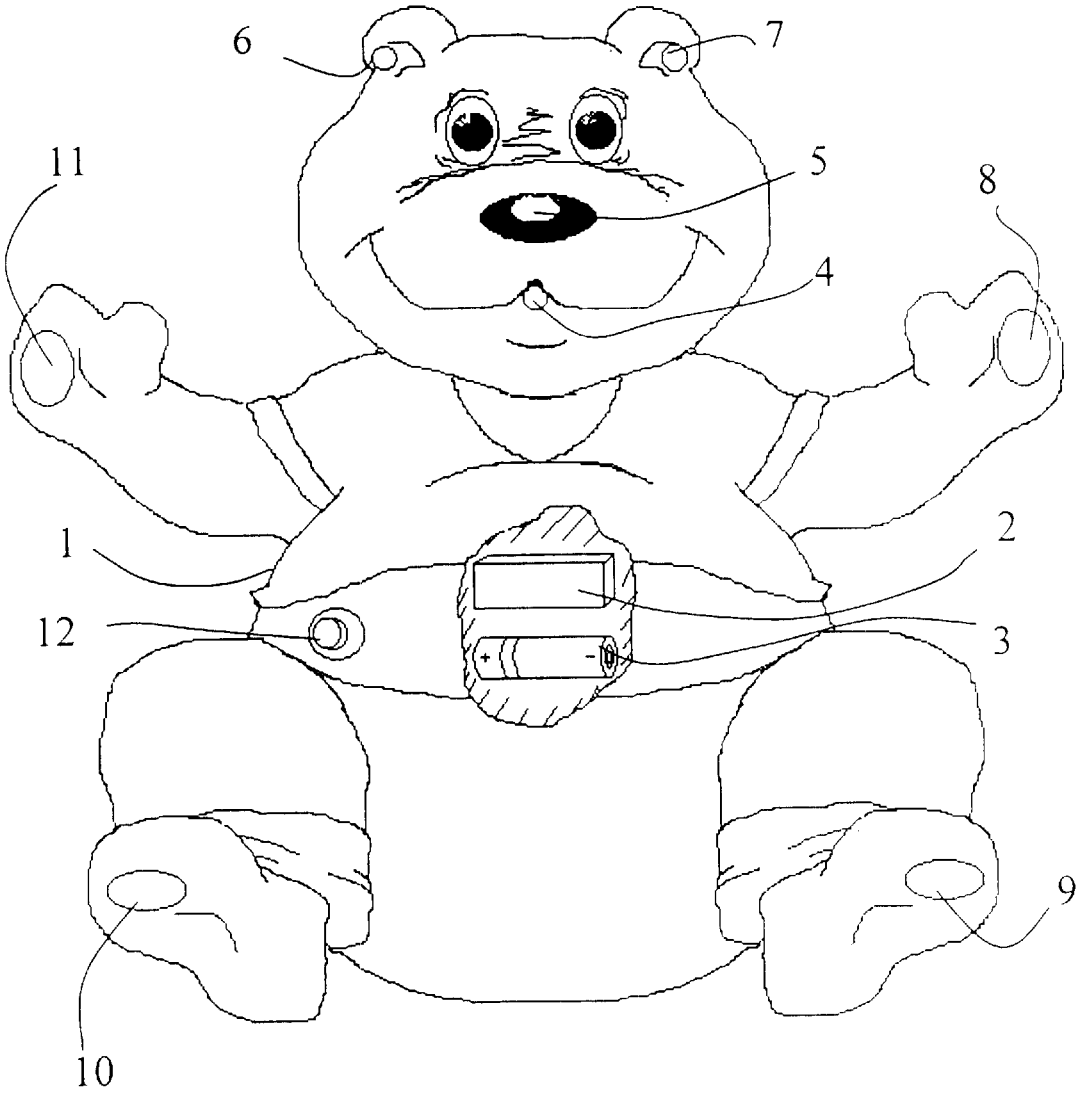
FIG. 1 shows an overall view of a talking toy.

As shown in FIG. 1, in the preferred embodiment of the present invention the talking toy is either a teddy bear or a doll. Inside toy housing 1 there are electronic block 2 and power supply 3. In a suitable part of the toy there is loudspeaker 4. Further, in housing 1 there is temperature sensor 5. In various parts of the toy there are touch sensors 6, 7, 8, 9 10, 11. There is also switch 12 inside housing 1.

Thermistor can serve as temperature sensor 5. Miniature switches can serve as touch sensors 6 . . . 11. Power supply 3 can contain several batteries.

Figure 2:
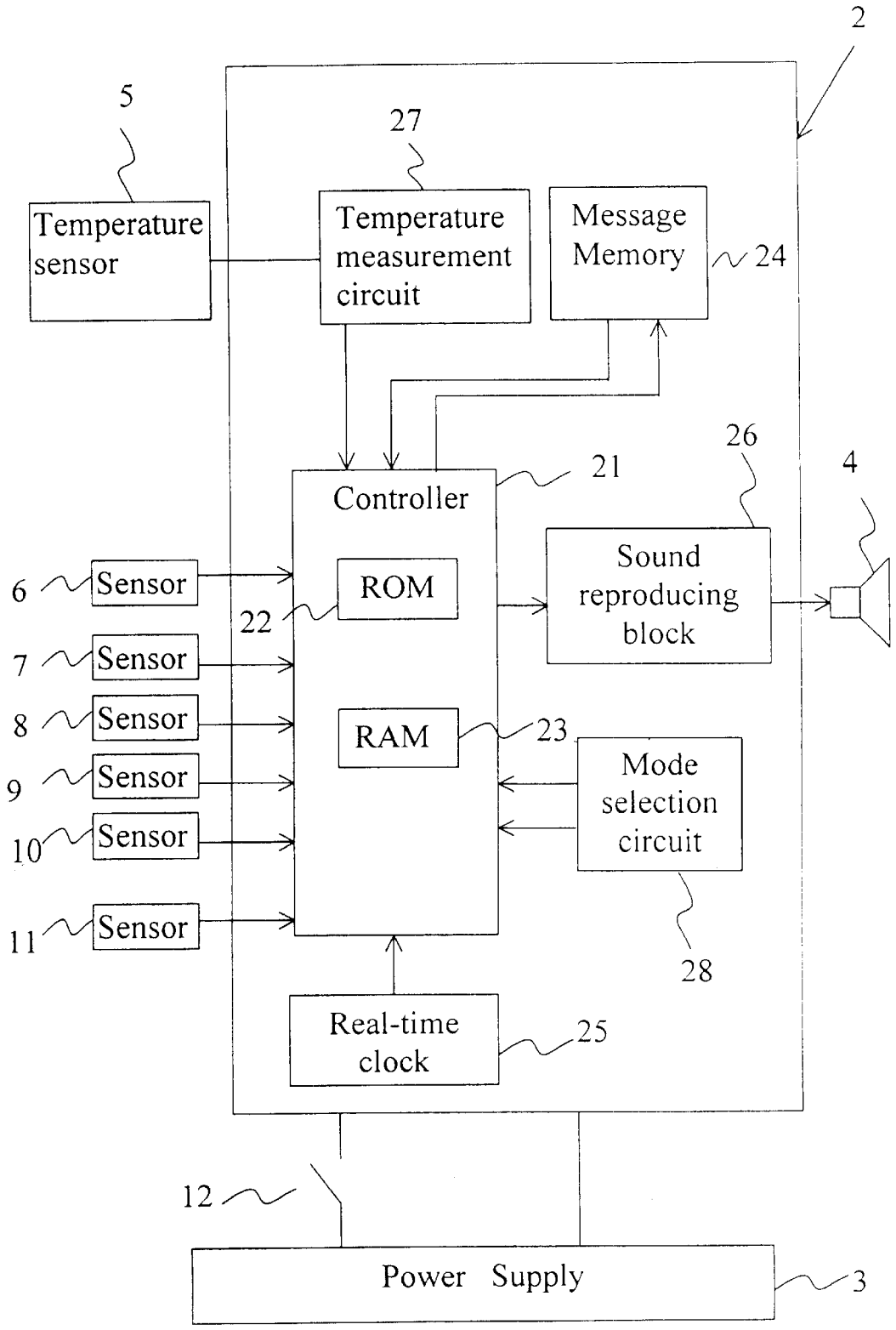
FIG. 2 shows an electric structural circuit of the talking toy.

As shown in FIG. 2, electronic block 2 comprises controller 21 that contains Read Only Memory (ROM) 22 and Random Access Memory (RAM) 23. There are message memory 24 and real-time clock 25 connected to controller 21. One of outputs of controller 21 is connected to sound reproducing block 26, the output of which is connected to loudspeaker 4. Temperature sensor 5 is connected to one of controller 21 inputs via temperature measurement circuit 27. Touch sensors 6 . . . 11 are connected to other inputs of controller 21. Voltage is sent from power supply 3 to electronic block 2 via switch 12. The power is supplied to real-time clock 25 gradually not to interrupt real time counting. Besides, mode selection circuit 28 is connected to controller 21.

Controller 21 can be implemented, for example, as microprocessor AT89C52, by Atmel Inc., USA, that has 8 KB ROM 22 and 256 byte RAM 23. Corresponding bits of input/output ports of controller 21 serve as its inputs and outputs. Message memory 24 can be nonvolatile memory with electric information deletion, for example, AT45D161, by Atmel Inc., USA. Real-time clock 25 can be implemented as a special integrated circuit, for example DS1305E by Dallas Semiconductor Corp., USA, that sends to controller 21 values of current date and time in digital format.

Sound reproducing block 26 comprises a digital-to-analog converter (DAC) and an amplifier that can be implemented on any appropriate integrated circuit. Temperature measurement circuit 27 comprises, for example, bridge resisting circuit to which temperature sensor 5 is connected, amplifier and analog-to-digital converter (ADC). Such circuits are well known in the art.

Mode selection circuit 28 can comprise a set of mechanical switches or jumpers with the help of which bits of controller 21 input/output ports are connected to lines of logical "0" or logical "1". As it is explained below, mode selection circuit 28 sets parameters that substantialy determine the personality of a character represented by the toy. In the preferred embodiment of the present invention said switches are installed during the toy production cycle. It is also possible to implement switches in such a way that a skilled user could change their placement himself/herself, thus, changing the toy behavior.

The toy shown in FIG. 1 and FIG. 2 reproduces audible messages recorded in message memory 24, when the user activates touch sensors 6 . . . 11 by pressing the corresponding parts of toy housing 1. As it will be shown below, the choice of a message for playback depends on current time, surrounding temperature value, on which sensor 6 . . . 11 is activated, on personality features preset for the given toy, as well as on a random factor. The complete number of messages from which a message can be chosen for reproduction is further denoted as NM, and the number of a message selected is denoted as N.

If the user does not activate the toy, it periodically reproduces messages itself. The choice of these messages depends on the factors discussed above. The length of an interval between such self-activated messages depends on the current time of the day.

Figures 3, 6:
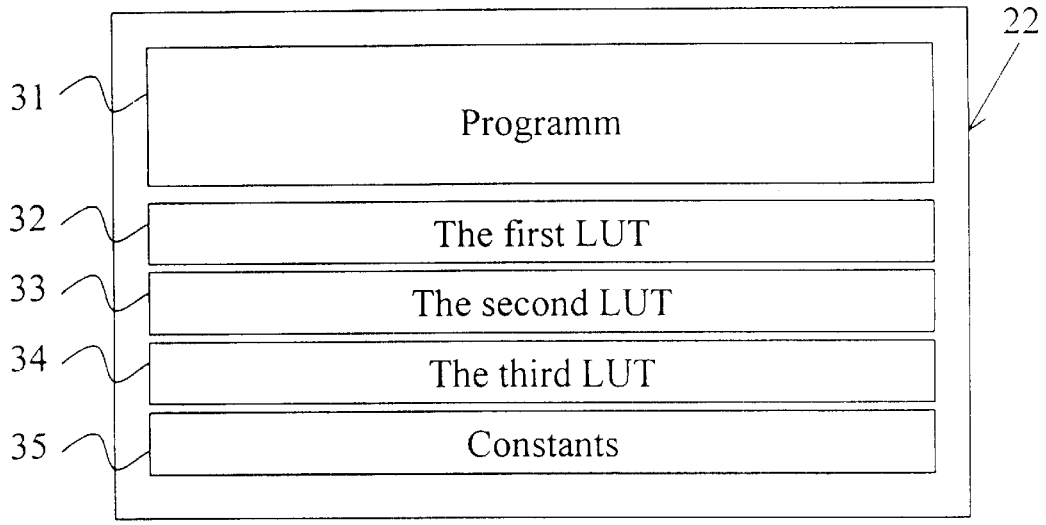
FIG. 3 shows data areas in Read Only Memory (ROM)
FIG. 6 shows time intervals value between reproduced messages for different time of the day values.

As shown in FIG. 3, ROM 22 comprises program area 31, where a program run by controller 21 is recorded. ROM 22 also comprises the first Look Up Table (LUT) 32, the second LUT 33, the third LUT 34 and constants area 35. The purpose of these areas will be explained further.

Figure 4:
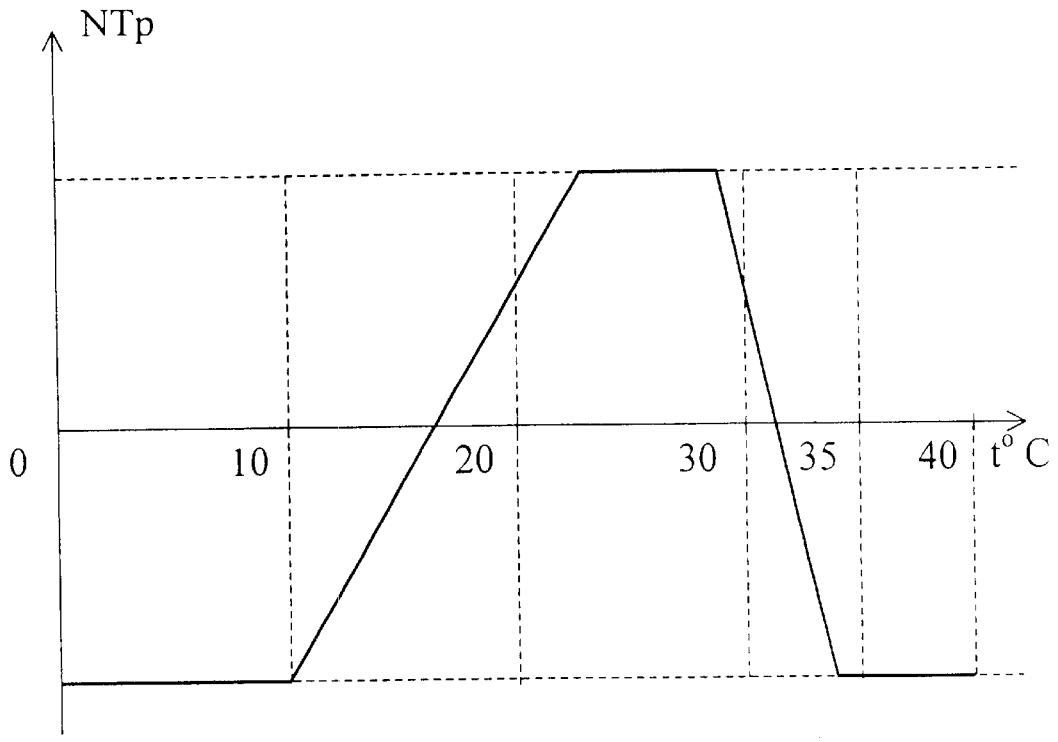
FIG. 4 shows a graphic expression of temperature influence on a reproduced message number.

In FIG. 4 there is a graphic expression of data in the first LUT 32. The input parameter for the first LUT 32 is the environment temperature value expressed in centigrade degrees and corresponding to horizontal reference axis in FIG. 4. The first LUT 32 comprises forty cells, each of which corresponds to a time interval equal to one centigrade. In every cell of the first LUT 32 the value of coefficient NTp is recorded. This coefficient is used to relate the environment temperature to the choice of an audible message. The values of coefficient NTp correspond to the vertical reference axis in FIG. 4 and change from the minimal value NTpMin up to the maximal value NTpMax. Absolute values NTpMin and NTpMax must be less than NM.

As can be seen in FIG. 4, in the preferred embodiment of the present invention the toy's most favourable range of temperatures is from 22° C. to 30° C., where the values of coefficient NTp are maximal. When temperature falls below 22° C. and goes over 30° C., coefficient NTp decreases, as these temperatures are less comfortable. Temperature values of 10° C. and 35° C. marked with vertical strokes indicate the borders below and above which accordingly conditions become uncomfortable.

Figure 5:
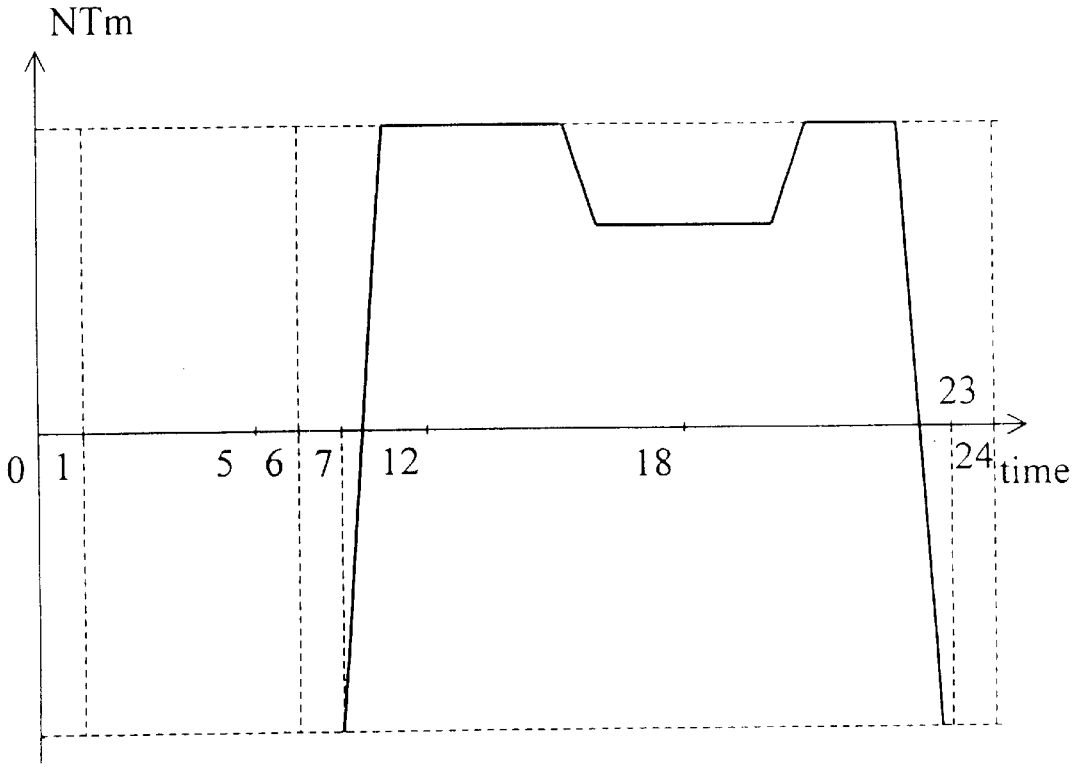
FIG. 5 shows a graphic expression of current time value influence on a reproduced message number.

FIG. 5 discloses a graphic expression of data in the second LUT 33. The input parameter of the second LUT 33 is the current time value expressed in hours and shown on the horizontal-reference axis in FIG. 5. The second LUT 33 comprises twenty four cells, each of which corresponds to a time interval equal to one hour. In every cell of the second LUT 33 there is a record of the value of coefficient NTm. This coefficient is used to relate the current time of the day to the choice of an audible message. The values of coefficient NTm correspond to the vertical reference axis in FIG. 5 and change from the minimal value NTmMin up to the maximal NTmMax. Absolute values NTmMin and NTmMax must be less than NM.

As can be seen in FIG. 5, in the preferred embodiment of the present invention the most favourable time interval for the toy is from 8 o'clock to 22 o'clock, in which values of coefficient NTm are positive. During the night time values of coefficient NTm are negative. Time values of 1 o'clock, 7 o'clock and 23 o'clock marked with vertical strokes indicate the borders of time intervals, in which reproduced messages are determined by different rules, as it is shown later in greater detail.

FIG. 6 shows a table of values of time intervals between self-activated message reproduction depending on the current time of the day. The value of the current time and of time intervals are given in hours. For the night time the values of said intervals are set equal to 12 hours, that in practice means that the toy will not start talking at night if not activated by the user. In the rest time of the day the interval between message reproductions fluctuate between ½ hour to ⅛ hour.

Going back to FIG. 3, the content of constants area 35 in ROM 22 will be discussed. Constants recorded here are used to compute number N of a message to be reproduced. Constant area 35 consists of segments, each of which corresponds to one of possible combinations of switches in mode selection circuit 28. Constants that have the same names but are stored in different segments of constants area 35 have different values.

Each segment of constants area 35 comprises constant NBase that characterizes the constant component of the number for a group of toys or a single toy. The value NBase can have a whole value in the interval from 1 to NM, where NM is a number of messages from which a choice is to be made.

Further, each segment of constants area 35 comprises constants NAct1, NAct2, NAct3, NAct4, NAct5, and NAct6 that depict how the choice of a message for reproduction depends on activation by the user of touch sensors 6, 7, 8, 9, 10, 11 accordingly. Constants NAct1. . . NAct6 can be both, positive and negative. In both cases absolute values of indicated constants must be less than the value of NM. The positive value of any of indicated constants shows that the activation of a corresponding touch sensor is "pleasant" for the toy, and the negative value of a constant shows that the activation of a corresponding touch sensor is "unpleasant" for the toy.

Finally, each segment of constants area 35 comprises constant NAccM that determines the width of digit interval for random number generator.

Figure 7:
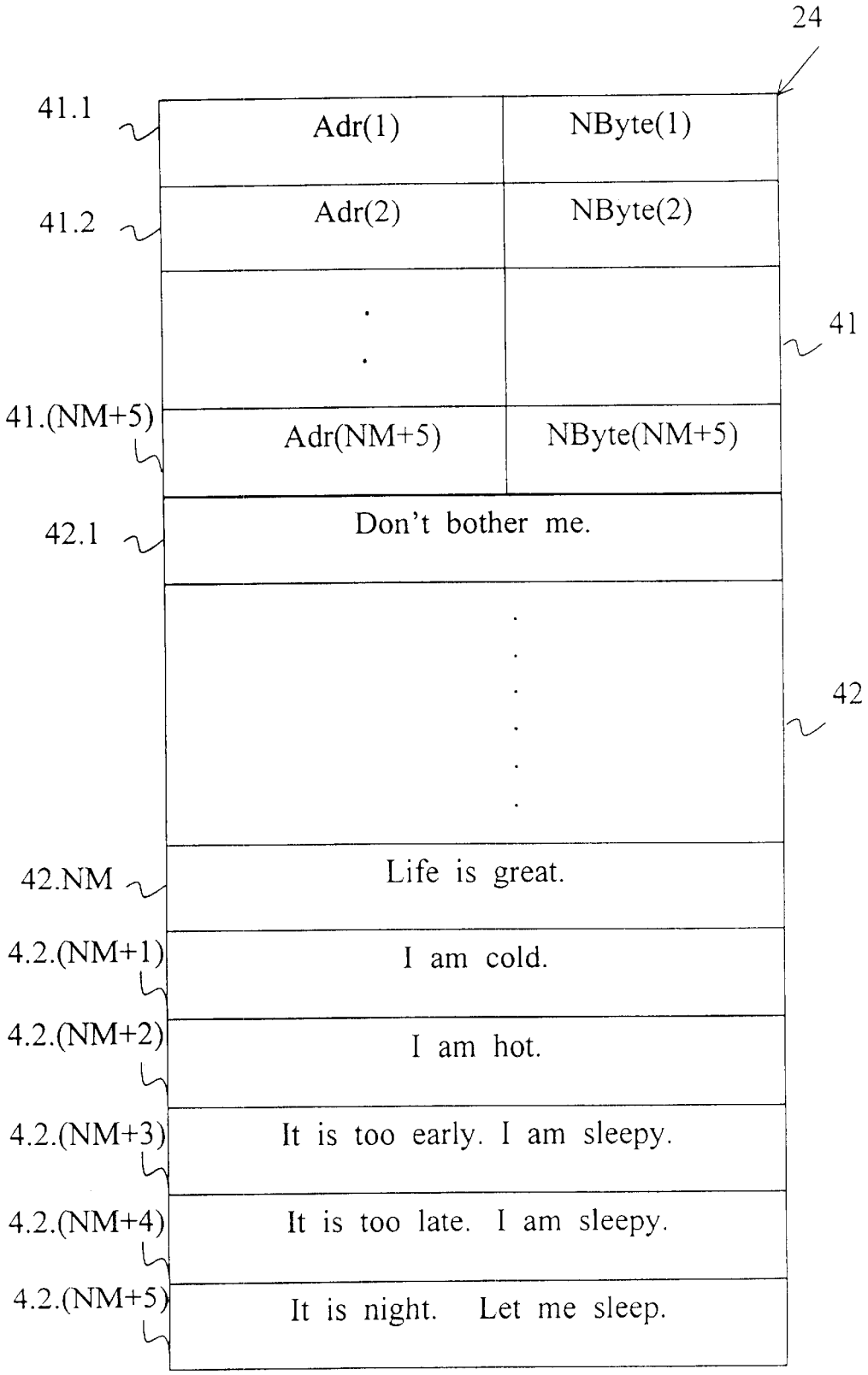
FIG. 7 shows data structure in message memory.

As shown in FIG. 7, message memory 24 comprises headers area 41 and messages area 42. Headers area 41 comprises headers 41.1 . . . 41.(NM+5), where NM+5 is a full number of recorded messages. All headers are equal in size, for example, 8 bytes, and comprise initial message address and message length in bytes. Messages area 42 comprises the actual sound messages 42.1 . . . 42.(NM+5). Every sound message is recorded either in a form of a sequence of sound signal samples, for example 2 bytes for every sample, or with the use of some known encoding method of said samples sequence, for example with predictive encoding. The recording of each sound message in message memory 24 begins with the address that is recorded in the message header and each message occupies a number of bytes also recorded in this message header. For more clarity, the samples of messages in FIG. 7 are given in a form of texts.

Messages with numbers from 1 to NM are designed for selective reproduction when activated by the user or when self-activated by the toy if the temperature of the environment and the current time of the day do not exceed the set limits. These messages are put in such an order that smaller numbers have messages that express discontent with user's actions or environment conditions, negative emotions; and bigger numbers have messages that express positive emotions, joy of communicating with the user, satisfaction with environment conditions.

The message with number NM+1 is reproduced if the surrounding temperature falls below 10° C. The message with number NM+2 is reproduced if the surrounding temperature is above 35° C. The message with number NM+3 is reproduced if time of the day value is in the interval between 5 and 7 o'clock in the morning. The message with number NM+4 is reproduced if the current time of the day value is in the interval between 23 o'clock in the evening and 1 o'clock in the morning. The message with number NM+5 is reproduced if the current time of the day value is between 1 o'clock in the morning and 5 o'clock in the morning. The messages with numbers NM+1 . . . NM+5 are further called predetermined as their reproduction is always connected with meeting of definite conditions.

Figure 8:
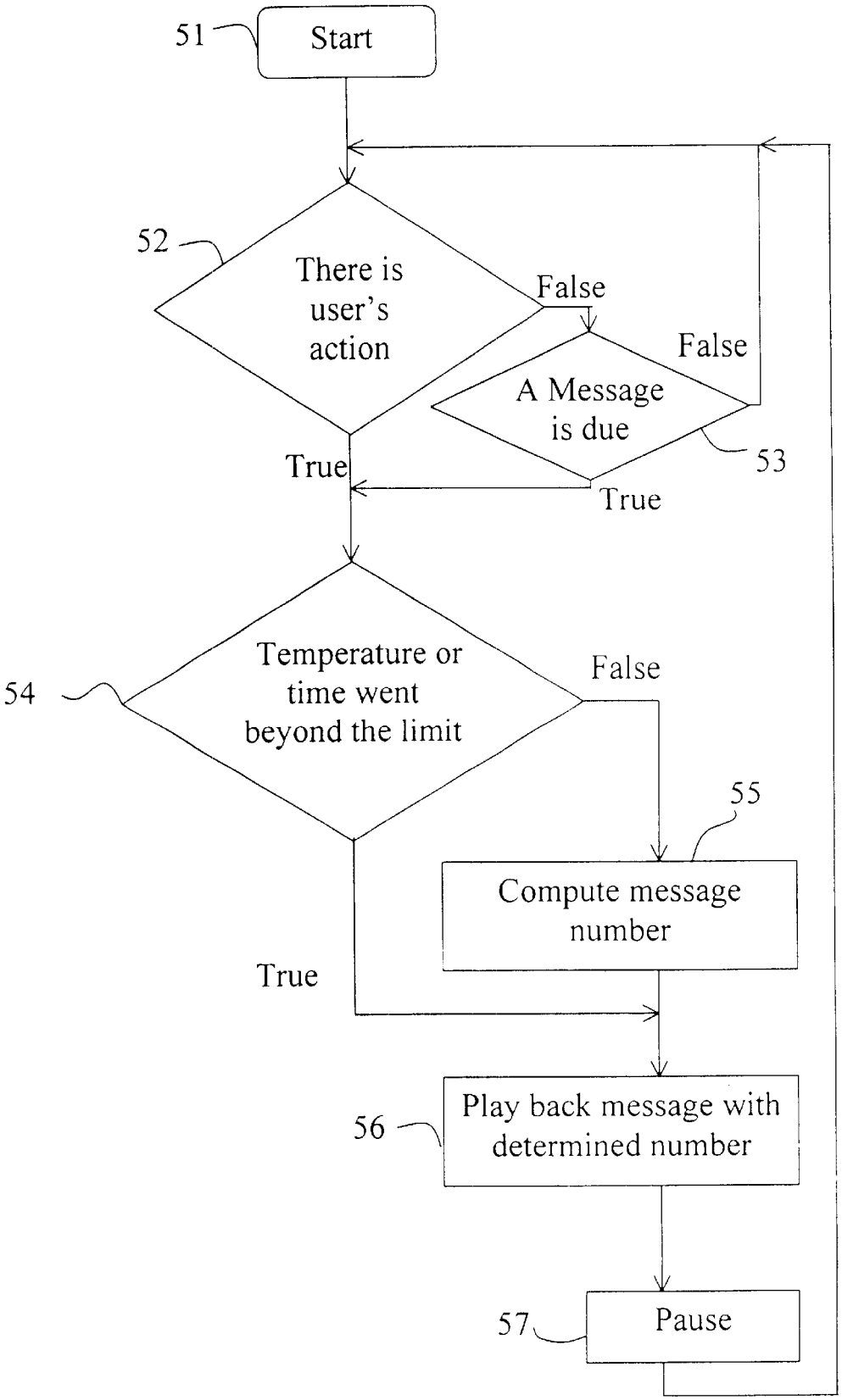
FIG. 8 shows a flowchart of a program carried out by controller in the talking toy.

Operation of controller 21 in the talking toy is carried out in accordance with the program recorded in ROM 22. As shown in FIG. 8, program operation begins when power of controller 21 is turned on by switch 12 (block 51). Then the program runs in a closed loop till power is turned off.

In the beginning of every loop the program checks if the user is interacting with the toy (block 52). For this purpose controller inquires sensors 6 . . . 11. If the user is interacting with the toy, the program goes over to subroutine 54 of checking values of temperature and current time. If the user is not interacting with the toy, the program checks if the time has come for self-activated message reproduction (block 53). At this point the program addresses real-time clock 25 and reads the value of current time, reads from LUT 34 the value of time interval between reproductions for the received current time value, determines what time interval has passed since the last message reproduction and compares two said intervals. If time interval since the last message reproduction is less than time interval read in the third LUT 34, the program returns to the beginning of the loop in block 54. In the opposite case, the program goes over to running subroutine 54.

In subroutine 54 the checking is carried out if the environment temperature is beyond the range of 10° C. . . . 35° C., and if the current time value is beyond time interval of 7 o'clock in the morning and 23 o'clock in the evening. If both said questions are answered negatively, the common answer of subroutine 54 is negative, and the program goes over to subroutine 55 of computing a message number for reproduction that will be discussed below. If time or temperature exceeds said limits, subroutine 54 gives a positive answer and determines the number of one of predetermined messages, after this the program goes over to subroutine 56 of reproducing messages with assigned numbers.

Subroutine 56 comprises the operations of finding message header by its number in message memory 24, of finding the beginning of a message by the address recorded in its header, of consistent reading of digital data from message memory 24, of the necessary decoding operations, of transmitting message samples values to sound reproducing block 26, in which digital data is converted to analog signal that creates sound in loudspeaker 4. Message reproduction will continue till the complete number of bytes is read from message memory 24. The value of the current time when the message was reproduced is fixed in ROM 23.

When a message has been reproduced a pause of preset length is made (block 57) so that there were pauses between messages in case the user exercises repeated interaction with the toy. Then the program returns to the beginning of the loop in block 52.

The program can also have a function of setting real-time clock 25 to the initial time, for example to 12 o'clock in the afternoon. This setting procedure is carried out after changing batteries in power supply 3. The initial time setting can be initiated, for example, by a certain combination of activating sensors 6 . . . 11. FIG. 8 does not show this operation.

Figure 9:
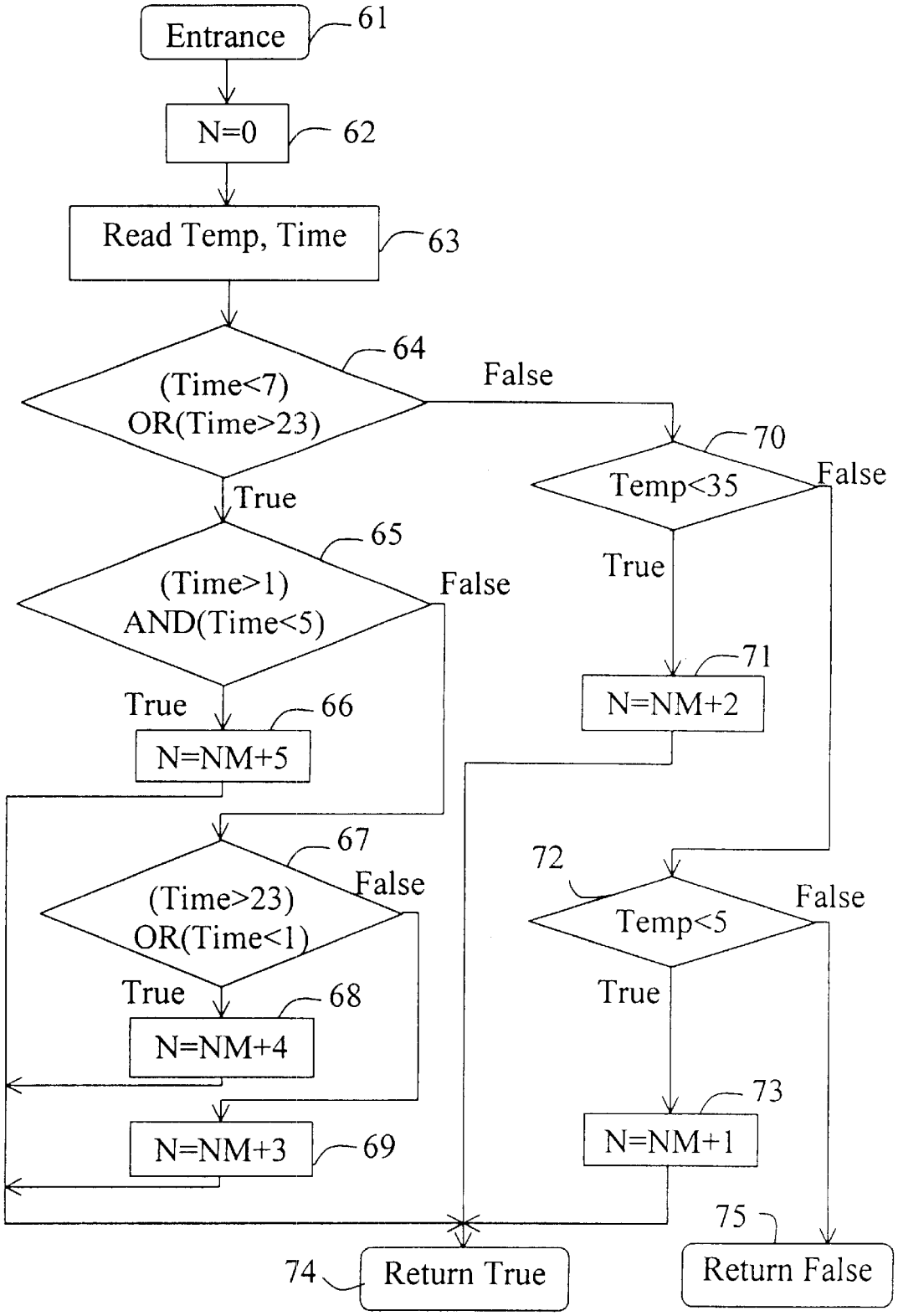
FIG. 9 shows a flowchart of a subroutine of current time and temperature values checking.

As shown in FIG. 9, after entering subroutine 54 (block 61), global variable N, which determines the number of a message to be reproduced, is set equal to zero. Then the program reads the value of surrounding temperature (Temp) from temperature sensor 5 and the current value of time (Time) from real-time clock 25 (block 63). Variables Temp and Time are global, that is their values are preserved after the subroutine under consideration terminates and can be used in other parts of the program.

Then it is checked if the current value of time is beyond the interval between 7 o'clock in the morning and 23 o'clock in the evening (block 64). If it is not beyond this interval (the answer is "False"), the program goes over to block 70. If the current value is beyond this interval (the answer is "True"), the program identifies in blocks 65 . . . 69 the number of a predetermined message that should be reproduced. If the current value of time falls within the interval from 1 o'clock in the morning to 5 o'clock in the morning (block 65), variable N gets the value of NM+5 (block 66). If the current value of time falls into the interval between 23 o'clock in the evening and 1 o'clock in the morning (block 67), variable N gets the value of NM+4 (block 68). Finally, if the current value of time falls within the interval from 5 o'clock in the morning to 7 o'clock in the morning (the answer in block 67 is "False"), variable N gets the value of NM+3 (block 69). After one of blocks 66, 68, 69 is fulfilled, subroutine 54 terminates in block 74, returns the logical value "True" and stores the found value of message number in variable N.

If the current value of time does not exceed the limits of the interval from 7 o'clock in the morning to 23 o'clock in the evening, the program checks in block 70 if environment temperature is not too high. If it is, the variable N gets the value of NM+2 (block 71), and subroutine 54 terminates in block 74. If it is not, the program in block 72 checks if the environment temperature is not too low. If it is, the variable N gets the value of NM+1, and subroutine 54 goes over to block 74, in which it terminates. If it is not, subroutine 54 terminates in block 75 returning the logical value "False". In this case variable N has the value of zero.

Figure 10:
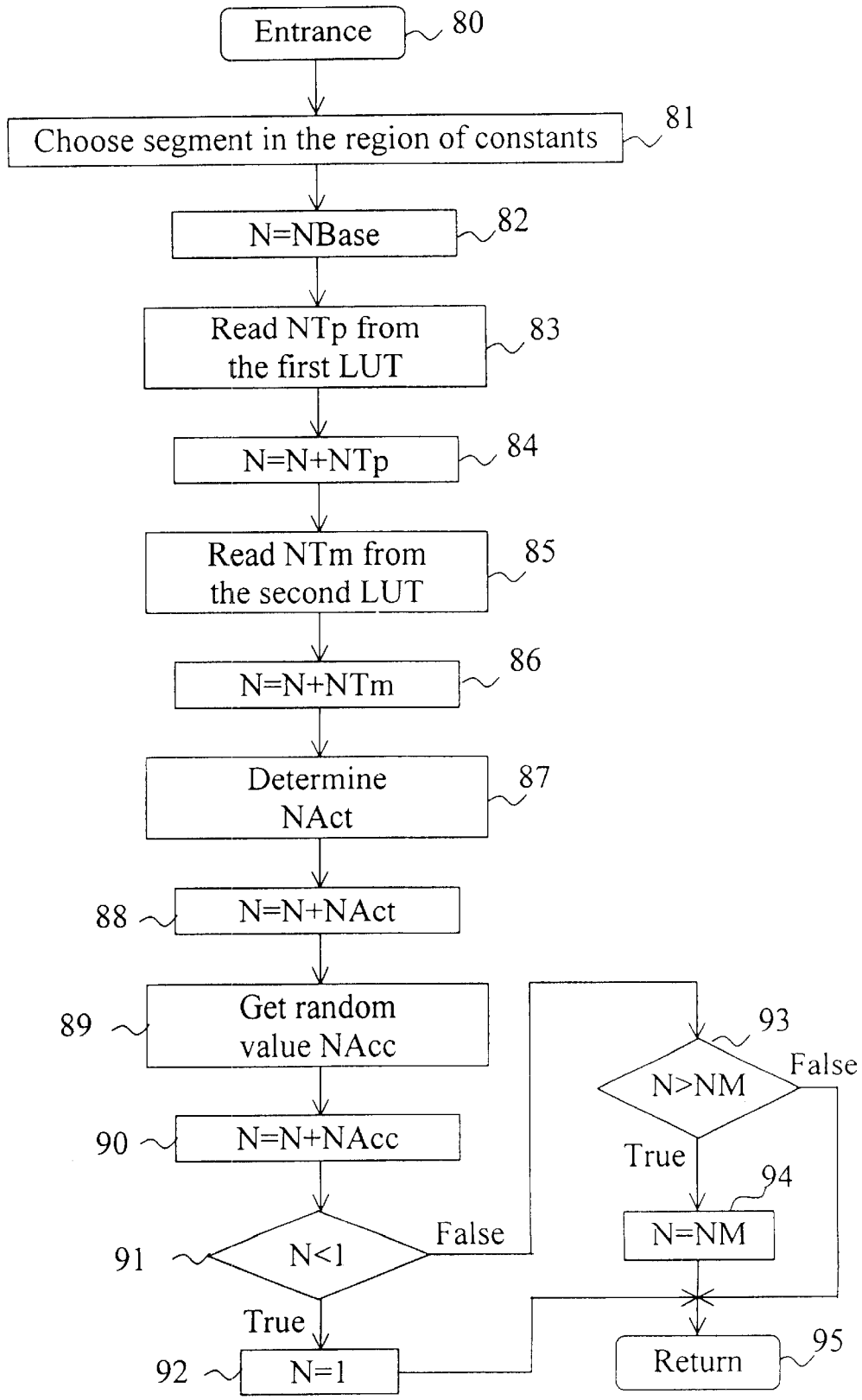
FIG. 10 shows a flowchart of a subroutine of computing the message number.

Turning to FIG. 10, a flow-chart of subroutine 55 of message number computation will be provided. After entering this subroutine (block 80) controller 21 inquires mode selection circuit 28 and selects in constants area 35 in ROM 22 a segment that corresponds to the combination of switches set in mode selection circuit 28 (block 81). Then variable N gets the value of constant NBase (block 82) recorded in the selected segment.

Then, with the help of temperature value Temp received in running of subroutine 54, the value of coefficient NTp is found out in the first LUT 32 (block 83). The found value NTp is added to the value of variable N (block 84). This way the influence of temperature on the message selection is taken into account.

Then, with the help of time value Time received in running of subroutine 54, in the second LUT 33 the value of coefficient NTm (block 85) is found out and then it is added to variable N (block 86). Due to this, the influence of the current value of time on the choice of a message for reproduction is taken into account.

After this the program gives variable NAct the value of one of constants NAct1 . . . NAct6 (block 87) depending on which touch sensor has been activated. The constant value is read from an earlier selected segment in constants area 35. Identification of a touch sensor activated was carried out in program block 52. If there was no user interaction and the reason for message reproduction was the end of a certain time interval after the previous message, then variable NAct gets the value of zero. Then the received value NAct is added to variable N value (block 88).

Then the program turns to subroutine of random numbers generator (block 89) which returns random number NAcc that can get values in the range from −NAccM to +NAccM, where NAccM is a constant read from the segment selected in constants area 35 in ROM 22. Received random number NAcc is added to the value of variable N (block 90).

Subroutine blocks 91, 92, 93 and 94 serve to prevent the value of variable N from going beyond the limits of the possible range of its values from 1 to NM. In block 95 subroutine 55 terminates returning the found value of variable N to the basic program, that is the number of a sound message that will be reproduced.

In the results of all the operations indicated above the number of a message to be reproduced is found by the following equation:

$$N=NBase+NTp+NTm+NAct+NAcc,$$

where value N only changes from 1 to NM. Value NBase is fixed for one toy. Values NTp and NTm accordingly depend on environment temperature and time, and value NAct depends on which touch sensor in the device is activated by the user. Let us introduce a designation $$NF=NBase+NTp+NTm+NAct.$$

Then, when the user repeatedly activates the toy in the same manner within a short period of time and the environment temperature remains unchanged, the value of N will range from NF−NAcc to NF+NAcc, and messages with corresponding numbers will be reproduced.

Activation of a different touch sensor will produce a different value NAct and consequently, a different value of NF. That is why when activating a different touch sensor the values of N will be from a different number range and corresponding messages will be reproduced.

For example, a teddy bear likes when it is touched by the front right pad, that is when the user activates sensor 11; and it does not like when it is touched by the left ear, that is when the user activates sensor 7. This means that constant NAct6 has a positive value, and constant NAct2 has a negative value. The range of values N that are received when the front right pad is activated will be closer to N=NM and further from N=1 than the range of values N received by activating the left ear. That is why pressure on the front right pad will be more pleasant for the teddy bear then the pressure on its left ear.

As time and temperature change, the range of values of N that are received when the user activates the toy shifts up or down. The mood of the talking toy either improves or sours, and it reproduces either more cheerful or more gloomy audible messages. The basic personality of the toy is set by values NBase and NAcc, that indicate accordingly an average position and width of the range of messages for reproduction. If NAcc is large enough, then even a toy with a pessimistic personality will sometimes say cheerful phrases.

Conclusion, Ramifications and Scope

As can be seen from the above description of the preferred embodiment of the invention, this invention provides new possibilities and significant advantages over the known talking toys. This is accounted by the fact that the choice of a sound message for reproduction by the toy is determined by permanent factors that reflect character features as well as by the type of the user interaction, by surrounding conditions, by time of the day, and also by a random factor. As a result, the same type of toy activation causes playback of different messages. The toy behavior becomes more natural and versatile, it increases the development and entertainment significance of the toy for the child.

The present invention makes it possible to quickly change toy's personality. To do so it is enough to change the position of switches in mode selection circuit 28. It is possible to manufacture several toy modifications with the same message memory 24 and with different sets of switches in mode selection circuit 28. These toys will reproduce sound messages of the same set, but some of them will tend to say phrases that are more gloomy and sad, while others will be more optimistic. It is also possible to provide user with a capacity to change toy's personality by shifting keys in mode selection circuit 28. Then a parent would be able to put a doll in a melancholic mood to prevent a naughty daughter from playing with it, and to resume the doll's playful mood, if the child is not misbehaving.

The ability to change toys' personalities can prove to be very useful for toy manufacturers and retailers as many of consumers would want to have, for example, several teddy bears with different personalities. Besides, same electronic blocks can be used in different toys. Such unification allows to cut product costs.

Message playback without user interaction in certain time intervals is an additional function of talking toys that can enhance its entertaining value.

Although the description above contains many specificities, these should not be construed as limiting the scope of the invention but as merely providing illustrations of the presently preferred embodiment of this invention. Many other ramifications are possible. Some of these variants are discussed below.

In talking toys not only keys that lock when the user presses certain parts of the toy can be used as touch sensors, but also sound sensors that are activated by a clap of the hands, by a whistle, etc.; infrared sensors that can be activated by a remote control unit, visible light sensors, radio-receiving devices, and other types of sensors. One toy can have sensors of several types.

Furthermore, not only temperature can be used as a characteristic of environment but atmospheric pressure, humidity, illumination, level of acoustic noise, etc. To detect these environment characteristics, it is necessary to install corresponding sensors, connect them to controller 21 and process this data in the program of selecting a message for reproduction.

Besides, in ROM 22 there can be several first LUTs 32, data from which determines variants of surrounding temperature influence on toy's mood. The choice of one of these LUTs can be done with the help of mode selection circuit 28. Similarly, there can be several second LUTs 33 and/or third LUTs 34 in ROM 22.

The dependencies shown in graphic and digital forms in FIG. 4, FIG. 5 and FIG. 6 are given in the description of the preferred embodiment of the present invention for illustrating purposes only. These dependencies can be absolutely different. For example, there can be toys that prefer morning or evening hours, cool weather, light frost or tropical heat. Self-activated messages can be either not included in toys functions or can be switched off by user's choice.

The content of messages can be very different. For example, there can be toys that say proverbs or quote famous philosophers, or sing Beatles songs. The choice of messages out of the set should just be close to the character's personality. There can be an option of replacing message memory 24 to change a set of messages.

Messages can be recorded in message memory 24 with the use of different coding methods to increase the total time of messages or to decrease the required volume of message memory 24. If controller 21 has good computation real-time speech synthesis capacity, then messages can be recorded in a form of texts.

The device reproducing sound messages can have an appearance not only of a toy but of any home appliance, part of home or office interior, etc. As such object acquires entertaining functions it still can be called a talking toy.

Having described the preferred embodiment of the invention with reference to the accompanying drawings, it is to be understood that the invention is not limited to these precise embodiment, and that various changes and modifications may be effected therein by one skilled in the art without departing from the scope or spirit of the invention as defined in the appended claims.

We claim:

1. A talking toy comprising:

a housing determining the form and appearance of said talking toy;

sound reproducing means for audible message reproduction;

a plurality of external activation sensors;

first storage means for storing audible messages, wherein each of said audible messages has a number, and said number is arranged so that a change of said number in an audible message corresponds to a change of the mood of the character represented by said talking toy, where said mood is expressed through said audible message;

second storage means for storing at least one number for each of said plurality of external activation sensors, wherein said number characterizes the effect of an external activation detected by said external activation sensor on the mood of the character represented by said talking toy; and message selection means, connected to said sound reproducing means, to said first storage means, to said second storage means, and to said plurality of external activation sensors and capable in respond to activating of at least one of said plurality of external activation sensors, for:

reading a first number corresponding to said at least one external activation sensor from said second storage means;

selecting a second number which is a random number;

determining the selected number of an audible message as a sum of said first and said second numbers; and selecting an audible message from said first storage means in accordance with said selected number and forwarding said audible message to said sound reproducing means for audible message reproduction.

2. The talking toy of claim 1, further comprising:

at least one environment sensor able to form a signal characterizing the magnitude of an environment parameter measured by said environment sensor;

third storage means for storing numbers that are recorded and characterize the effect of said environment parameter on the mood of the character represented by said talking toy, and each of said number corresponds to an interval of magnitudes of said environment parameter;

wherein said message selection means are additionally connected to said at least one environment sensor and said third storage means and are further capable in accordance with the signal received from said at least one environment sensor to read a third number from said third storage means and determine said selected number as a sum of said first number, said second number, and said third number.

3. The talking toy of claim 2, wherein said at least one environment sensor is a temperature sensor.

4. The talking toy of claim 1, further comprising:

an electronic clock connected to said message selection means; and fourth storage means for storing numbers that are recorded that characterized the effect of the time of the day on the mood of the character represented by said talking toy, and each said number corresponds to an interval of the time of the day;

wherein said message selection means is additionally connected to said electronic clock and said fourth storage means and are further capable in accordance with time received from said electronic clock to read a fourth number from said fourth storage means and determine said selected number as a sum of said first number, said second number, and said fourth number.

5. The talking toy of claim 1, wherein at least two of said first storage means, at least two of said second storage means, at least two of said third storage means and, at least two of said fourth storage means are parts of a single integrated circuit.

6. A talking toy comprising:

a housing determining the form and appearance of said talking toy comprising;

sound reproducing means for audible messages reproduction;

at least one activation sensor; and storage means for storing audible messages, wherein each of said audible messages has a number, and these numbers are arranged in accordance with changes in the mood expressed through audible messages of the character represented by said talking toy;

mode selection means for selecting at least one mode number characterizing the mood of the character represented by said talking toy;

message selection means connected to said sound reproducing means, to said storage means, to said mode selection means, and to said at least one activation sensor, for:

reading a first number from said mode selection means;

selecting a second number;

determining the selected number of an audible message as a sum of said first and second numbers; and selecting an audible message from said storage means in accordance with said selected number and to forward said audible message to said sound reproducing means for audible message reproduction in response to activation of said at least one activation sensor.

7. The talking toy of claim 6, wherein said second number is a random number.

8. The talking toy of claim 6, wherein said mode selection means further comprises control means for changing said at least one mode number thereby changing the mood of the character represented by said talking toy.

9. The talking toy of claim 6, wherein said at least one activation sensor is selected from a mechanical sensor, and acoustic sensor, and optical sensor, and radio receiver.

10. The talking toy of claim 6, wherein said at least one activation sensor is a timer.

11. The talking toy of claim 6, wherein said selection parameters are numbers and said combination of selection parameters is the sum of these numbers.

12. A talking toy comprising:

a housing determining the form and appearance of said talking toy;

sound reproducing means for audible message reproduction;

a plurality of sensors;

storage means for storing of a plurality of audible messages, arranged in accordance with the mood expressed through said audible messages of the character represented by said talking toy; and message selection means connected to said sound reproducing means, to said storage means, and to said plurality of sensors, for:

receiving data from at least two out of said plurality of sensors;

in accordance to said data to determine selection parameter: characterizing the influence of said at least two sensors effects on the mood of the character represented by said talking toy; and selecting from said storage means an audible message in accordance to a combination of said selection parameters and forwarding said audible message to said sound reproducing means for audible message reproduction in response to activation of at least one of said plurality of sensors.

* * * * *